US006497084B1

(12) United States Patent
Jänen

(10) Patent No.: US 6,497,084 B1
(45) Date of Patent: Dec. 24, 2002

(54) CARTON BLANK TRANSPORT APPARATUS

(75) Inventor: Johannes Jänen, Troisdorf (DE)

(73) Assignee: Riverwood International Corporation, Atlanta, GA (US)

( * ) Notice: Subject to any disclaimer, the term of this patent is extended or adjusted under 35 U.S.C. 154(b) by 0 days.

(21) Appl. No.: 09/297,417

(22) PCT Filed: Oct. 29, 1997

(86) PCT No.: PCT/GB97/02977

§ 371 (c)(1),
(2), (4) Date: Jul. 9, 1999

(87) PCT Pub. No.: WO98/18677

PCT Pub. Date: May 7, 1998

(30) Foreign Application Priority Data

Oct. 31, 1996 (GB) ..... 9622710

(51) Int. Cl.[7] ..... B65B 41/00; B65H 5/00

(52) U.S. Cl. ..... 53/389.5; 53/389.4; 271/10.01; 271/12

(58) Field of Search ..... 53/48.8, 48.6, 53/389.1, 389.2, 389.4, 389.5; 271/273, 271, 12, 10.01, 110, 34, 185

(56) References Cited

U.S. PATENT DOCUMENTS 4,118,025 A * 10/1978 Konars et al. ..... 271/273
4,877,232 A * 10/1989 Nakanishi ..... 271/10
4,924,653 A * 5/1990 Oly ..... 53/66
5,109,975 A * 5/1992 Prettie ..... 271/185
5,172,898 A * 12/1992 Takahashi ..... 271/10
5,401,012 A * 3/1995 Taruki ..... 271/10
5,671,587 A * 9/1997 Robinson ..... 53/48.8
5,673,536 A * 10/1997 Easter et al. ..... 53/48.8
5,673,911 A * 10/1997 Loftus et al. ..... 271/273
6,089,565 A * 7/2000 Voorhees et al. ..... 271/273
6,128,107 A * 10/2000 Kawashima ..... 271/10.09
6,311,457 B1 * 11/2001 May et al. ..... 53/389.1

FOREIGN PATENT DOCUMENTS

DE 27 21 138 * 1/1978
EP 0 602 299 * 6/1994

* cited by examiner

*Primary Examiner*—Gregory M. Vidovich
*Assistant Examiner*—Marc Jimenez
(74) *Attorney, Agent, or Firm*—Womble Carlyle Sandridge & Rice, PLLC

(57) ABSTRACT

There is provided transport apparatus for carton blanks 11. The blanks are delivered to a pair of rotating nip rollers 17 by using a segment wheel 15 and a swinging suction arm 16. The nip rollers 17 are drive at a predetermined speed so as to deliver the blanks 11 between two pairs of endless belts 18, 19 which are driven at the same speed as each other, the speed of the belts being slower than that of the nip rollers 17. The blanks 11 are, therefore, received by the nip rollers 17 in a pitched manner but the relative speeds ensures that the blanks are transported by the endless belts 18, 19 in an unpitched, end to end relationship.

5 Claims, 5 Drawing Sheets

CARTON BLANK TRANSPORT APPARATUS

FIELD OF THE INVENTION

The present invention relates to apparatus for transporting carton blanks in a packaging machine from a pitched carton pick mechanism to an unpitched carton folding mechanism.

BACKGROUND OF THE INVENTION

In known packaging machines which are pitched, for example machines for producing multipacks of bottles or cans, carton blanks are held in a magazine and are picked off one by one by a carton feeder before being transported in a pitched manner to an area where they are folded around the articles to be packed. In a packaging machine which is not pitched, the carton blanks have to be transported to the folding area in back to back fashion, aligned with the unpitched articles supplied by the infeed mechanism of the packaging machine.

SUMMARY OF THE INVENTION

According to the present invention there is provided transport apparatus for transporting carton blanks from a pitched carton pick mechanism to an unpitched carton folding mechanism, said transport apparatus comprising: a pair of nip rollers for rotation at a first speed which rollers receive the carton blanks at pitched intervals, at least one pair of opposed endless belts which in use move at an identical second speed, the belts defining therebetween a gap, the blank being received in the gap and conveyed by the belts, the gap at the upstream end of the belts nearest the nip rollers being widened such that the nip rollers accelerate the blanks into the widened gap, the distance between the nip rollers and the non-widened section being substantially equal to the carton length such that downstream of the widened section the successive blanks are disposed in end to end relationship.

Preferably two pairs of endless belts are provided at laterally spaced locations for receiving lateral extremities of the cartons. In preferred arrangements the gaps between the pairs of belts widen slightly at their downstream ends to facilitate removal of the extremities of the cartons.

In some arrangements the length of the widened upstream section between the nip rollers and the non-widened section of the endless belts is variable to enable the apparatus to be used with cartons of different lengths. Conveniently the upstream end of one belt of each pair is guided by two spaced guide rolls at its upstream end, the axes of the rolls being located on a line parallel to the path of travel through the non-widened section, the most upstream first guide roll being of smaller diameter than the second guide roll which constitutes the junction of the widened upstream section, the smaller diameter first guide roll effecting said gap widening.

A preferred feature is that the axis of the second guide roll is movable along said parallel line to effect the variable length of the widened upstream section. Normally the lower belt of each pair is provided with said first and second guide rolls.

Typically the upstream widened section and the non-widened section of the endless belts are angled downwardly so as, in use, to approach from above a stream of product moving unpitched along a substantially horizontal product path. Also the downstream widened section of the endless belts is substantially parallel to and above part of the horizontal product patch so as, in use, to place the successive carton blanks on to successive groups of products as side folding arms engage the blank and pull the lateral extremities of the blank from between the pairs of endless belts.

An embodiment of the present invention will now be described in more detail.

DETAILED DESCRIPTION

Figure 1:
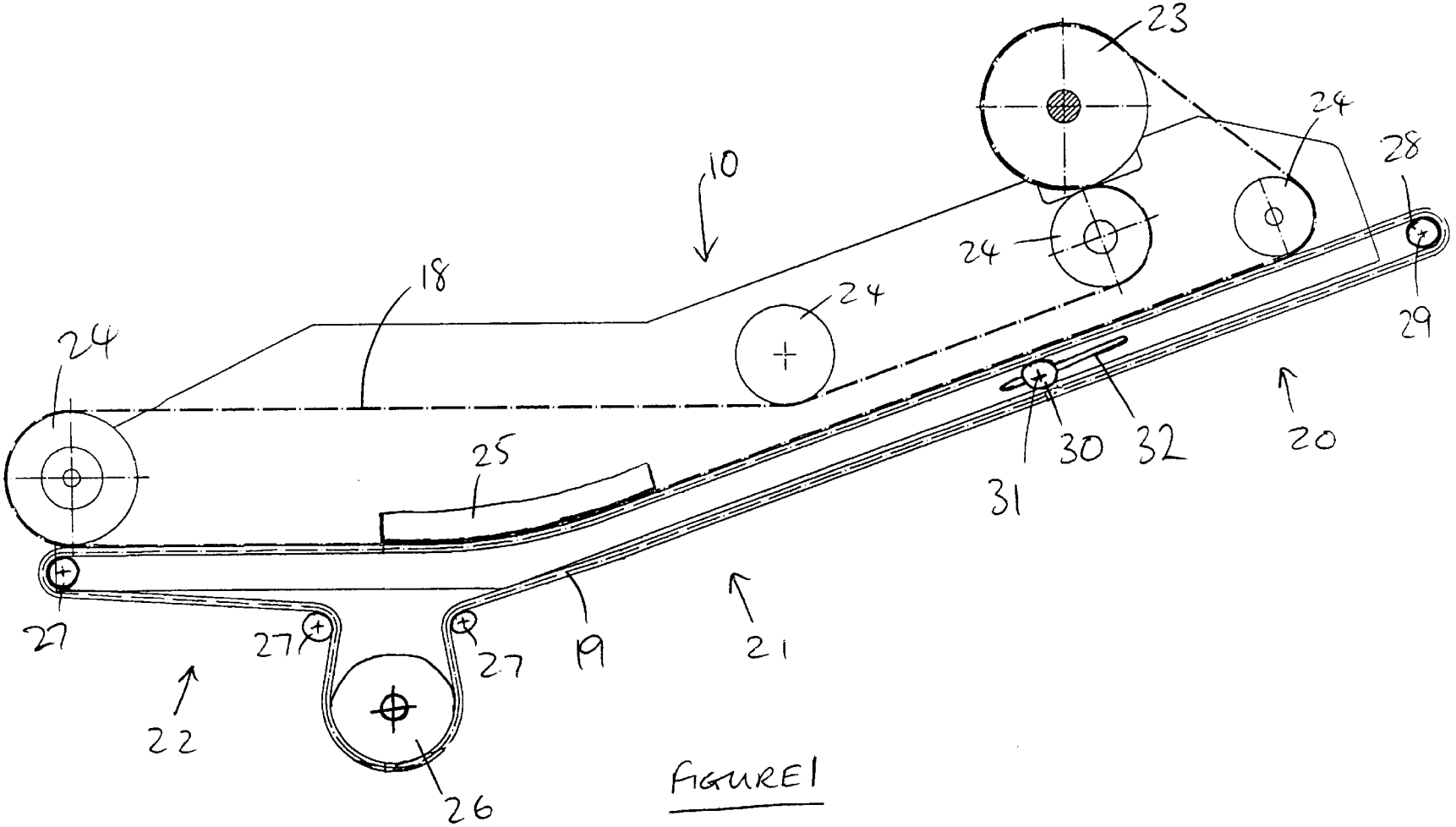
FIG. 1 is a schematic side view showing a carton transport apparatus according to the present invention.
Figure 2:
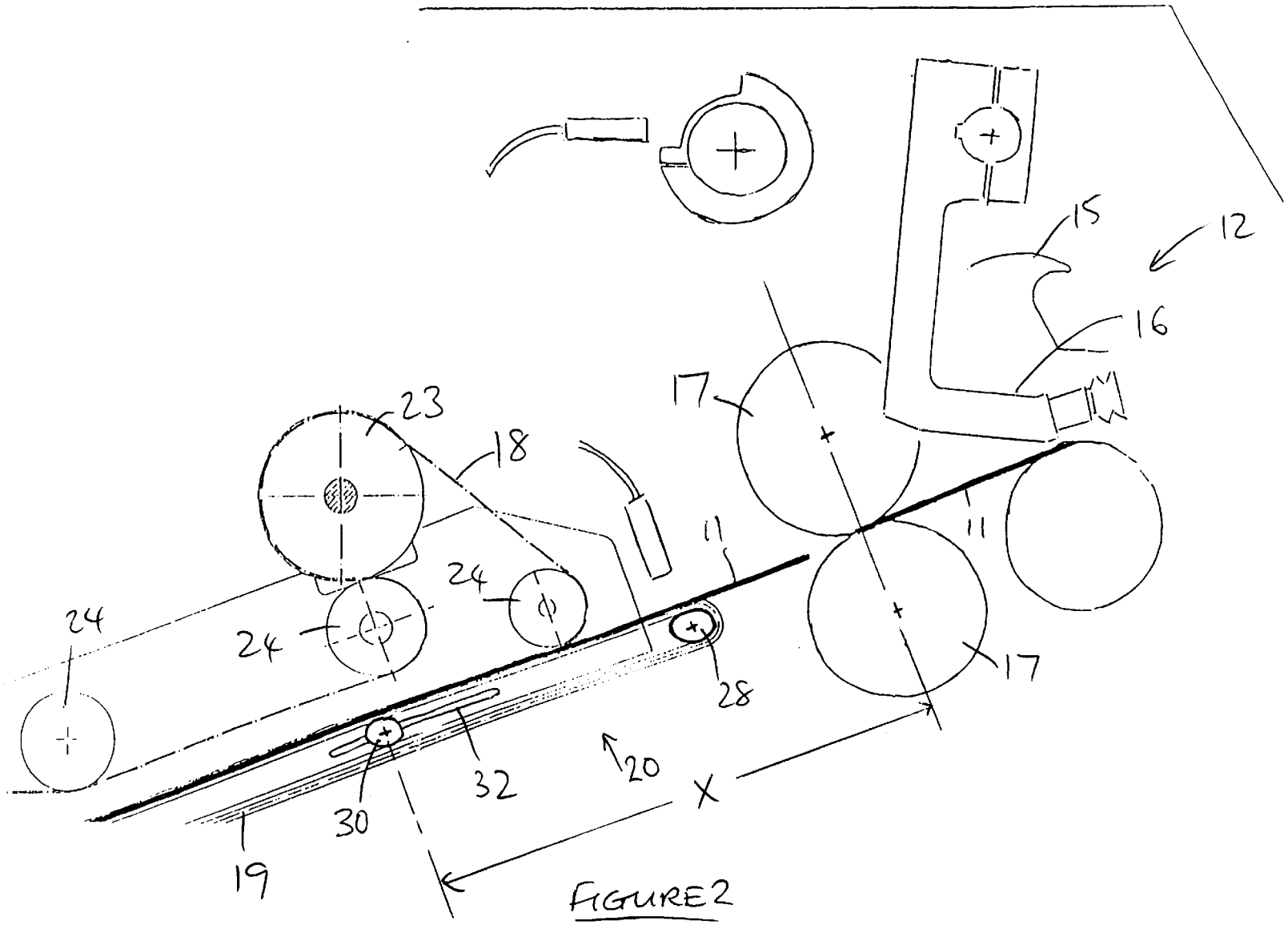
FIG. 2 is a schematic side view of part of the carton transport apparatus.

In the figures there is shown transport apparatus 10 for moving a carton blank 11 from a carton feeder arrangement 12 to a carton folding arrangement 13 where the blanks 11 are folded around a plurality of articles 14. In the embodiment shown the articles 14 are bottles and the blanks 11 form wraps around bottles 14, the necks of which project through corresponding holes in the blank 11. Machines to form such wraps from blanks 11 are known. These known machines are however pitched in that the articles to be wrapped are supplied to the folding area in distinct groups of a certain size and the blanks are also transported in a pitched manner to the articles from the carton feeder arrangement.

Pitched machines however have a number of problems associated with them. Firstly, the articles have to be separated into distinct groups with a fixed distance between the groups. This requires additional mechanisms, such as flight bars or side transport lugs, which are undesirable. Secondly the machines are inherently less efficient in operation because there are empty spaces passing through the machine.

The transport apparatus 10 enables blanks 11 to be delivered in an unpitched manner to an unpitched flow of articles which are wrapped in an unpitched folding section. The term unpitched means that the articles are fed in a constant stream in back to back manner but it can also incorporate a product pitched arrangement where the articles are fed in a constant stream with a regular space between the articles.

In the drawings, there is shown part of the carton feeder arrangement 12. Such feeders 12 are known and so the operation of it will not be described in detail. Other types of carton feeder arrangement are known and could be used in place of the one illustrated. Essentially the feeder arrangement picks the end carton blank 11 from a pile of blanks 11 located in a magazine (not shown) using a rotating segment wheel 15 and a swinging suction arm 16. The blanks are then delivered to a pair of rotating nip rollers 17 between which the blanks pass and which are driven at a predetermined speed.

Figure 3:
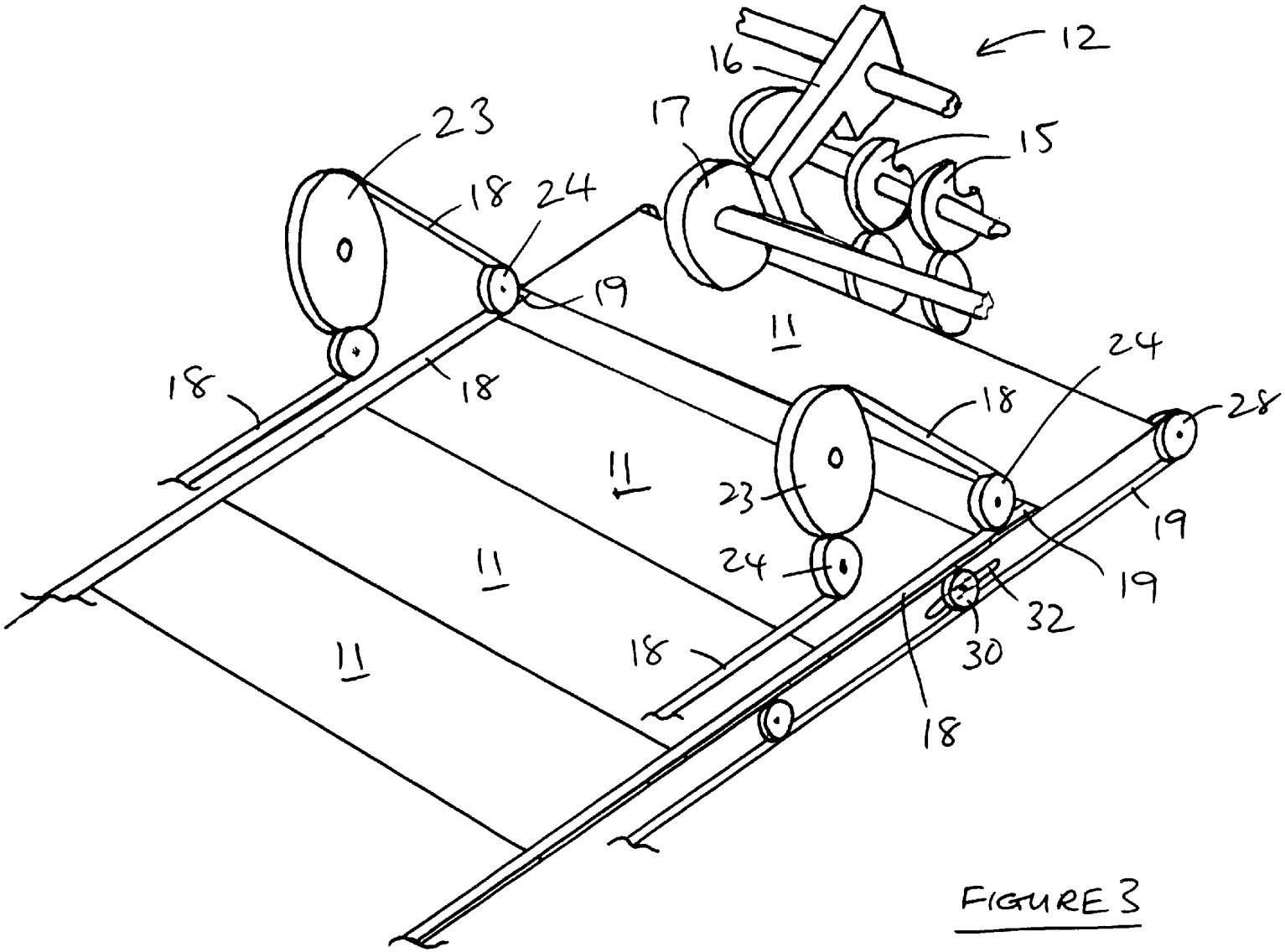
FIG. 3 is a perspective view from above of the apparatus of FIG. 2.

The blanks 11 are driven by the nip rollers 17 to the transport apparatus 10 which comprises two pairs of cooperating endless belts 18, 19. One pair of belts 18, 19 is provided for each lateral marginal edge portion of the blanks 11 as can clearly be seen from FIGS. 3. and 4. The action of the two pairs of belts 18, 19 mirror each other and so the action of only one pair will be described.

In order for the packaging machine to operate on an unpitched stream of articles, the blanks 11 must also be provided in an unpitched stream. The blank feeder arrangement 13 is, however, pitched. Each pair of belts, an upper belt 18 and a lower belt 19, comprises first, second and third sections 20, 21, 22. The upper belt 18 is driven by a drive roller 23 and is guided around free rollers 24 and a fixed guide 25. The lower belt 19 is driven by a drive roller 26 and is guided around free rollers 27, 28, 30 such that in the second section 21 the upper and lower belts 18, 19 are separated by a small gap so that they grip and transport a blank which is located therebetween. The upper and lower belts are both driven at the same machine speed as that of the unpitched folding section 13.

In the first section 22 the gap between the two belts widens slightly. The free guide roller 28 which is most upstream has an axis of rotation 29 which is aligned with the axis 31 of the second guide roller 30. This alignment of axes is substantially parallel to the upper belt 18 in this first section 20. However the first guide roller 28 is of slightly smaller diameter than the second guide roller 30 such that at the upstream end of the belts 18, 19 the gap between them is wider than in the second section 21.

Figure 4:
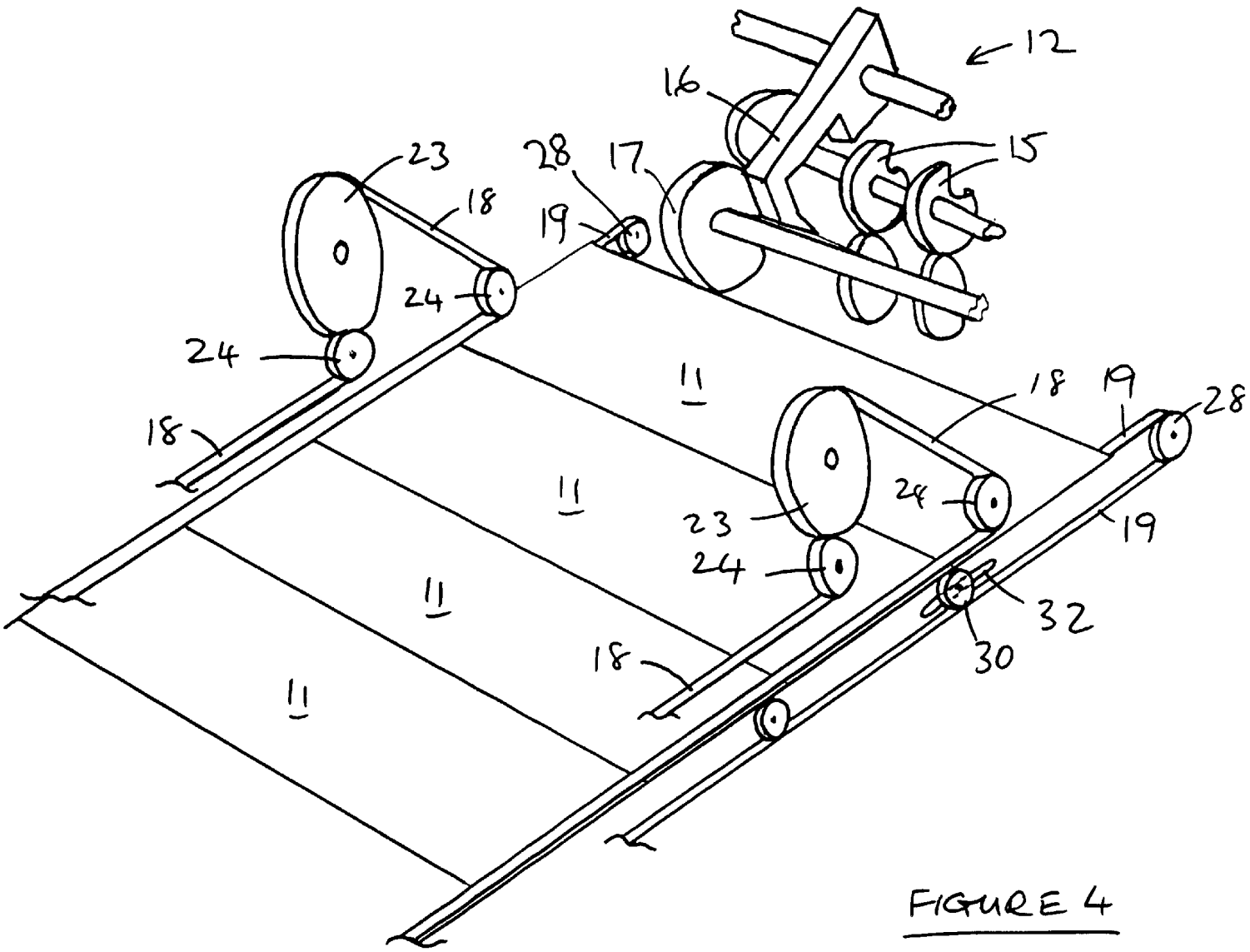
FIG. 4 is a perspective view similar to that of FIG. 3 at a different time.
Figure 5:
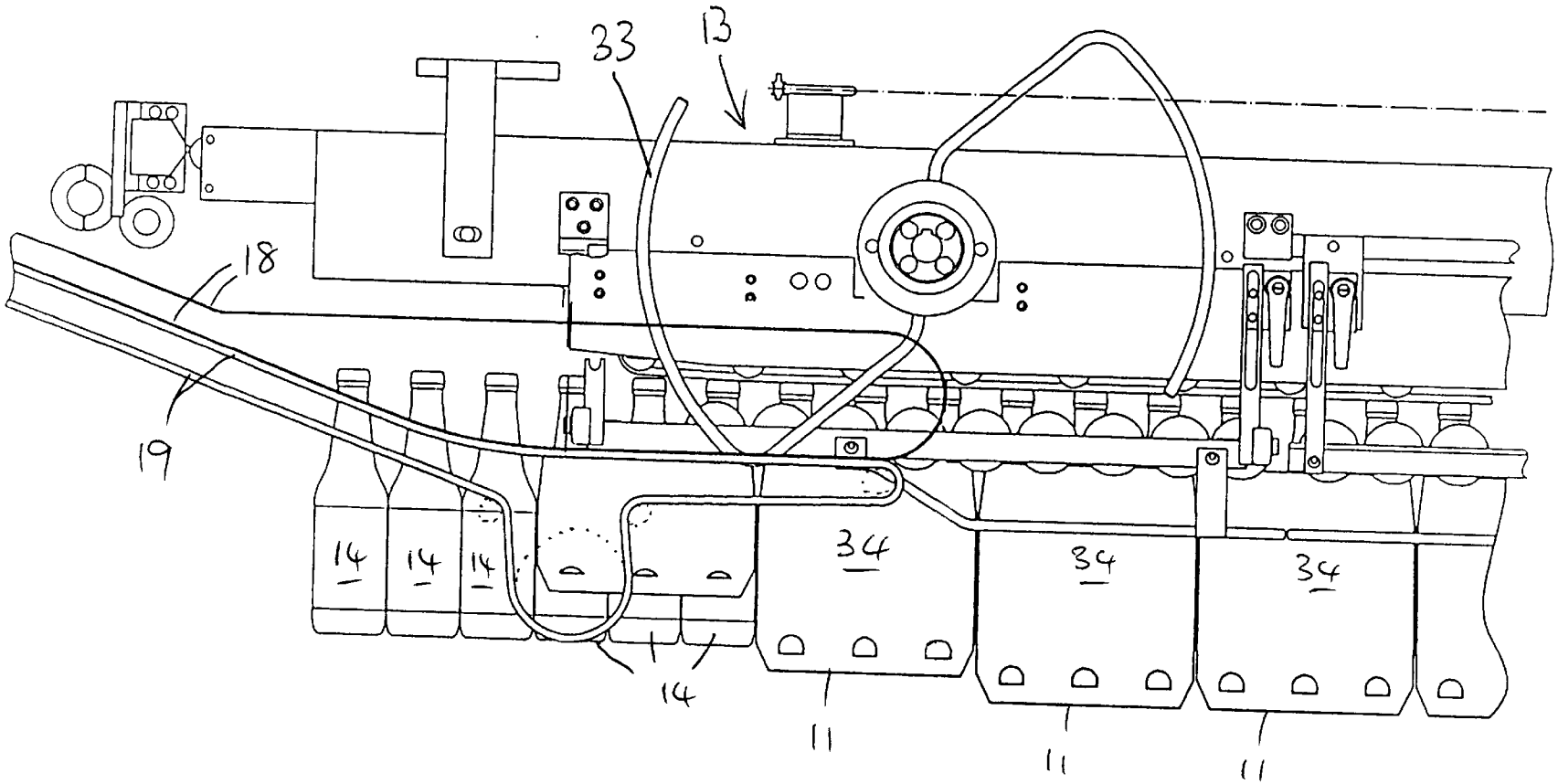
FIG. 5 is a reverse schematic side view of a further part of the carton transport apparatus.

The axis 30 of the second guide roller is located a distance X from the nip rollers 17 and this distance X is equal to the length of the carton blank in the machine direction. In addition the speed of the nip rollers 17 is faster than the machine speed of the upper and lower belts 18, 19. The nip rollers 17 therefore "shoot" the blanks between the belts 18, 19 (see FIG. 3) and the relative speeds of the rollers 17 and the belts 18, 19 is such that a following blank catches up the previous blank because the nip rollers drive it downstream quicker than the previous blank which is now being driven only by the slower belts 18, 19. The widening of the first section 20 ensures that the following blank is not affected by the belts 18, 19 until it reaches the second guide roller 30 at which point the upstream end of the blank is leaving the faster nip rollers 17 (see FIG. 4). The relative speeds are such that the following blank is caused to abut the previous blank at the second guide roller 30 to produce an unpitched supply of blanks in the second section 21 of the belts. The same operation occurs for subsequent blanks.

In the arrangement shown the location of the axis 31 of the second rollers is adjustable along the lower belt 19. This is ideal for accurate setting up of the apparatus and enables the apparatus to be changed so that it can operate on blanks 11 of different length. The distance between the nip rollers 17 and the axis 31 of the second guide rollers 30 is changeable so as to be equal to the length of the blanks. This adjustability is achieved by having the axis of the second guide rollers 30 being slidable along a slot 32 and lockable in any chosen position.

In the second section 21, the belts 18, 19 hold the edges of the blank tightly and transport them to the moving stream of bottles 14 below and into engagement therewith. The apparatus is of course synchronized using known techniques such that the blanks and bottles are correctly in register with each other and moving at the same speed.

The third section 22 of the belts 18, 19 sees a further slight widening of the gap between the belts. This coincides with the blanks 11 entering the folding section 13 of the packaging machine. By this time the second section 21 of the belts has guided the blanks downwardly into engagement with the bottles 14. In the third section 22, a side folding device 33, well known in the field, engages and folds down the sides 34 of the blanks 11 ready for tightening and locking. The slight widening of the gap between the belts in this third section enables the edges of the blanks to withdraw easily from between the belts 18, 19.

The result is an effective unpitched carton transport for an unpitched packaging machine.

It will be clear to the skilled reader that other ways of widening the upstream gap are possible as are other ways of making the device adjustable for different length cartons and accuracy.

It further will be understood by those skilled in the art that while the invention has been disclosed with reference to preferred embodiments, various modifications, changes and variations can be made thereto without departing from the spirit and scope of the present invention as set forth in the following claims.

What is claimed is:

1. A transport apparatus for transporting carton blanks from a pitched carton pick mechanism to an unpitched carton folding mechanism, said transport apparatus comprising:

a pair of nip rollers which rotate at a first speed; and, a pair of cooperating endless belts spaced from and aligned with said pair of nip rollers and which rotate at a second speed, wherein said first speed is faster than said second speed, said pair of cooperating endless belts defining a gap therebetween in which the blanks are received, said pair of belts including a first section defining an upstream widened gap section between said endless belts, a second section defining an unwidened gap section and a third section defining a downstream widened gap section between said endless belts, wherein said upstream widened gap section is wider than said unwidened gap section and said downsteam widened gap section is wider than said unwidened gap section, wherein said first section and said second section of said pair of belts are angled downwardly and said third section of said pair of belts is substantially horizontal, and wherein at least one of said belts is received about a guide roller that is movable with respect to said nip rollers so as to adjust spacing between said unwidened gap section and said nip rollers, wherein said spacing is substantially equal to a length of the blanks.

2. The transport apparatus of claim 1, further including another pair of endless belts spaced laterally from said pair of endless belts.

3. The transport apparats of claim 1, wherein the length of said upstream widened gap is variable.

4. The transport apparatus of claim 1, further comprising a first guide roller and a second guide roller, wherein said first guide roller has an axis of rotation aligned with an axis of said second guide roller and said first guide roller has a smaller diameter than said second guide roller.

5. The transport apparatus of claim 4, wherein said first guide roller is upstream of said second guide roller.

* * * * *